United States Patent [19]

Dickson

[11] Patent Number: 4,646,481

[45] Date of Patent: Mar. 3, 1987

[54] SURFACE BLASTING APPARATUS

[75] Inventor: Wayne E. Dickson, Tecumseh, Okla.

[73] Assignee: Dickson Industries, Inc., Tecumseh, Okla.

[21] Appl. No.: 729,466

[22] Filed: May 1, 1985

Related U.S. Application Data

[63] Continuation-in-part of Ser. No. 498,846, May 27, 1983, abandoned.

[51] Int. Cl.[4] ..... B24C 9/00

[52] U.S. Cl. ..... 51/424; 51/425; 51/432; 51/436

[58] Field of Search ..... 51/424–426, 51/428–429, 431–433, 434, 436–437, 430; 198/669

[56] References Cited

U.S. PATENT DOCUMENTS

| | | | |
|---|---|---|---|
| 2,423,287 | 7/1947 | Beisel | 51/430 |
| 3,934,373 | 1/1976 | Lelinert et al. | 51/425 |
| 4,020,596 | 5/1977 | Bergh | 51/425 |
| 4,363,571 | 12/1982 | Jackson et al. | 198/669 X |
| 4,376,358 | 3/1983 | Shelton | 51/424 X |
| 4,382,352 | 5/1983 | Nelson | 51/424 |

FOREIGN PATENT DOCUMENTS

| | | | |
|---|---|---|---|
| 2072549 | 10/1981 | United Kingdom | 51/426 |

*Primary Examiner*—Frederick R. Schmidt
*Assistant Examiner*—Debra S. Meislin
*Attorney, Agent, or Firm*—William R. Laney

[57] ABSTRACT

A surface blasting apparatus for treating a surface with abrasive, cleaning dust and debris from abrasive rebounded from the treated surface so that the abrasive may be reused, and separating the debris from the air. Air and debris flow through abrasive rebounded from said surface and through a baffle system which prevents abrasive flow therethrough. A row of magnets is positioned adjacent the baffle system for receiving and arresting abrasive exiting an abrasive return chute. A mechanical conveying system lifts abrasive upwardly so that it falls toward an abrasive storage hopper. The abrasive falls in the form of a curtain through which air exiting the baffle system passes. The air and dust contained therein enter a prefilter in a first cleaning chamber and heavy dust falls downwardly therefrom. The air flows from the prefilter into a second cleaning chamber where it is filtered so that light dust is removed therefrom and falls downwardly. Large debris is also removed from the abrasive and discharged to the first cleaning chamber. A dust and debris auger system transfers the removed dust and debris to a common opening in the first and second cleaning chambers for removal from the apparatus.

6 Claims, 5 Drawing Figures

SURFACE BLASTING APPARATUS

1A. RELATED APPLICATION

This application is a continuation-in-part of Wayne E. Dickson U.S. patent application Ser. No. 498,846, filed May 27, 1983, now abandoned, the details of which are incorporated by reference.

BACKGROUND OF THE INVENTION

1. Field of the Invention

This invention relates to surface cleaning equipment, and more particularly to a surface blasting apparatus which recovers blasting abrasive and debris from the treated surface, and provides means for separating the debris from the abrasive.

2. Brief Description of The Prior Art

A number of types of surface blasters have been heretofore devised which recover abrasive and debris from the treated surface and utilize various methods to separate debris from the abrasive, so that the cleaned abrasive can be reused. Some of such surface blasting apparatus utilize mechanical pickup of the abrasive from the treated surface and a conveying system to carry the abrasive back to an abrasive storage hopper.

The prior surface blasters use a variety of methods to clean the abrasive so that the abrasive can be reused without frequent interruptions in service. One method of such cleaning is to use an air wash which passes through the abrasive carrying dust and debris away. A problem is that this air wash does not provide adequate cleaning of the abrasive, so that frequent stops to manually clean the abrasive are required. Also, the prior blasters do not adequately clean the air which is discharged from the machine which results in undesirable dust problems for the operator and passersby.

The apparatus of the present invention provides a means of adequately air cleaning the abrasive and filtering the dust and debris from the air stream.

BRIEF DESCRIPTION OF THE PRESENT INVENTION

The surface blasting apparatus of the present invention comprises magnetic receiving means for receiving abrasive rebounded from the treated surface which removes all kinetic energy therefrom, a baffle system or means for allowing air flow therethrough without passage of abrasive therethrough for a first abrasive cleaning operation, and means to draw air through the apparatus so that is passes through a falling curtain of abrasive for a second abrasive cleaning operation.

The apparatus also comprises means for removing heavy foreign debris picked up from the treated surface, heavy dust removing means in the form of a prefilter and light dust removing means in the form of a filter. The surface blaster also comprises an auger system which provides means for transferring the debris and dust to a common opening for removal from the apparatus.

One object of the present invention is to provide a baffle means for allowing air flow therethrough while preventing abrasive flow therethrough so that the air may remove dust and debris from a stream of abrasive rebounded from the treated surface.

A further object of the invention is to provide an auger means for removing large debris from the abrasive and transferring said large debris to a cleaning compartment for removal therefrom.

Still another object of the invention is to provide a means of air cleaning a flow of abrasive at two positions in the apparatus and filtering dust and debris from said air flow.

An additional object of the invention is to provide means for transferring all dust and debris removed from the abrasive and air streams to a single location in the apparatus for removal therefrom.

Additional objects and advantages of the invention will become apparent as the following detailed description of the preferred embodiment is read in conjunction with the accompanying drawings which illustrate such preferred embodiment.

DETAILED DESCRIPTION OF THE PREFERRED EMBODIMENTS

Figure 1:
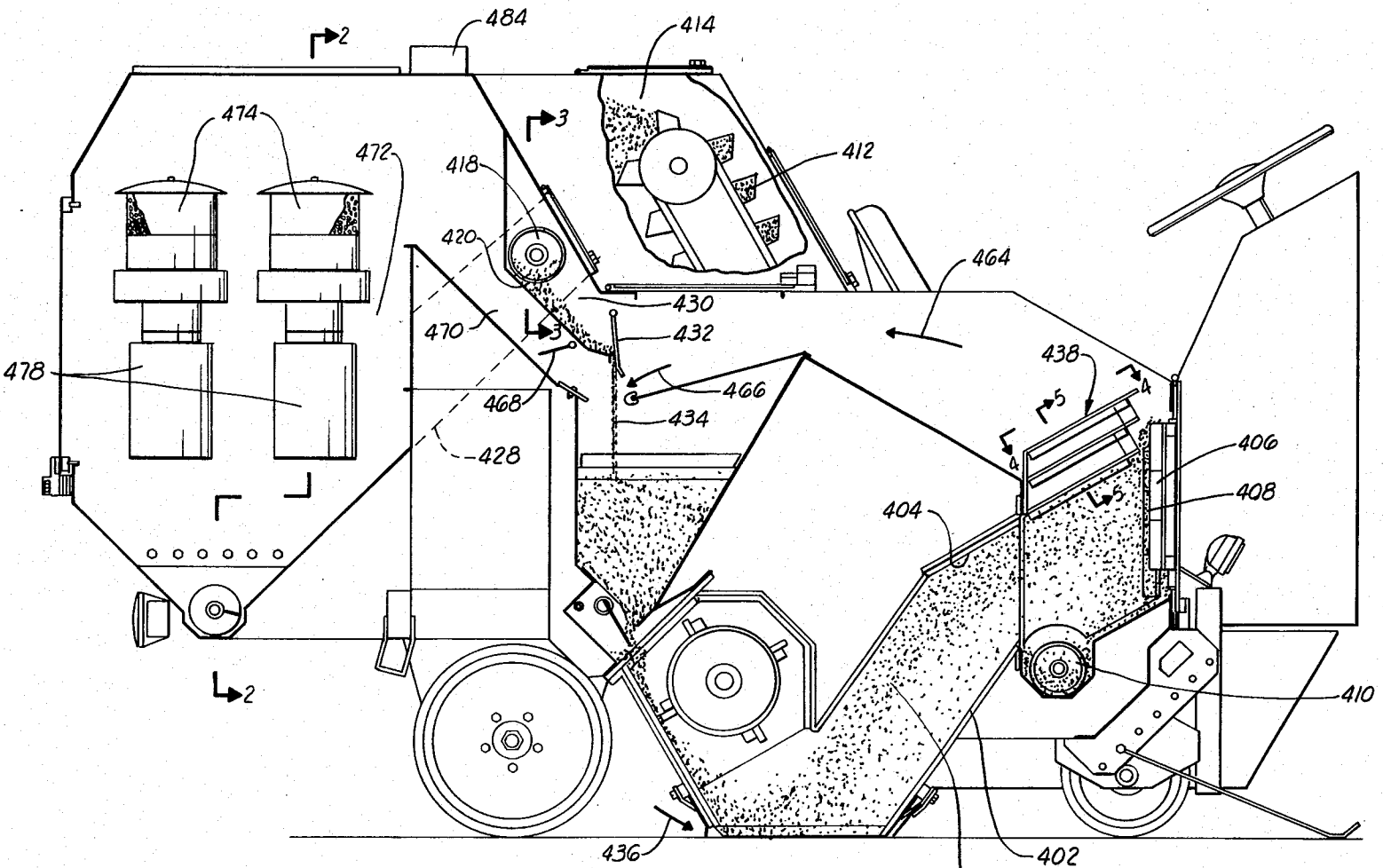
FIG. 1 is a partial longitudinal cross-section of the surface blasting apparatus of the present invention.

Referring now to the drawings, and particularly to FIG. 1, abrasive stored in a storage hopper is supplied to a rotary blast wheel and thrown to the surface to be treated. A stream of abrasive 400 rebounds from the treated surface through abrasive return chute 402 of substantially uniform cross-section. A deflector plate 404 at the exit of chute 402 directs abrasive 400 toward a magnetic receiving means in the form of vertically disposed magnets 406. Because the abrasive is ferrous, an envelope 408 of abrasive forms around magnets 406. As the stream of abrasive 400 strikes abrasive envelope 408, the abrasive is arrested and then falls downwardly, eventually coming to rest adjacent lower abrasive auger 410. The abrasive is moved transversely with respect to the surface blaster toward the lower end (not shown) of a bucket-type conveyor 412 of a kind known in the art. The abrasive is carried upwardly by conveyor 412 to a position above the hopper and discharged therefrom into upper abrasive compartment 414.

Figure 3:
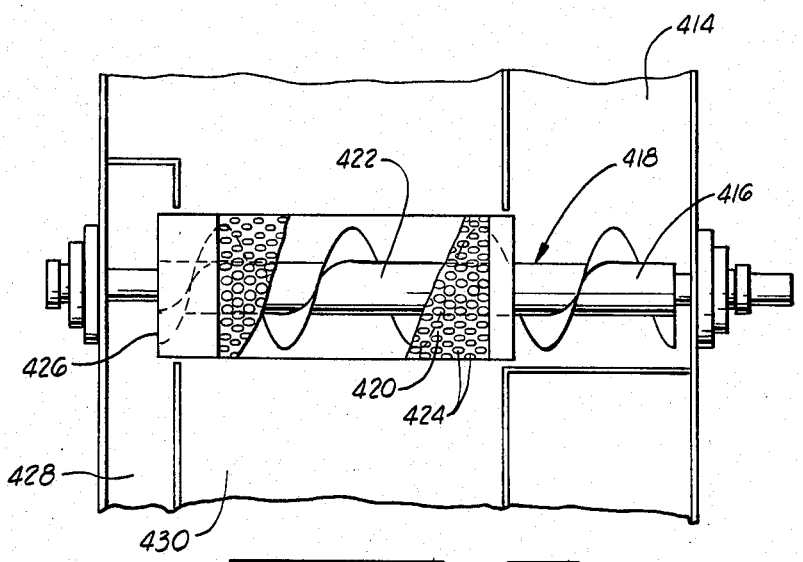
FIG. 3 is a cross-section taken along line 3—3 in FIG. 1.

Referring now to FIGS. 1 and 3, abrasive falls downwardly in compartment 414 toward an open end 416 of an upper abrasive auger 418. The abrasive is then moved transversely by auger 418 toward filter screen 420 which encloses a second portion 422 of auger 418. As viewed in FIG. 3, the abrasive moves in a leftward direction. Filter screen 420 includes a plurality of openings 424 which are sized such that abrasive may fall therethrough. However, large debris, such as foreign material picked up from the treated surface, will not fall through openings 424 but is instead moved further transversely to fall from open end 426 of filter screen 420 into large debris chute 428.

As abrasive falls through openings 424 in filter screen 420, the abrasive enters abrasive return chute 430 and continues downwardly toward abrasive control valve 432. Abrasive control valve 432 is weighted, and when sufficient abrasive builds up in abrasive return chute 430, the valve will automatically open and abrasive will be allowed to fall downwardly toward the hopper, forming a curtain 434 of abrasive.

Figure 4:
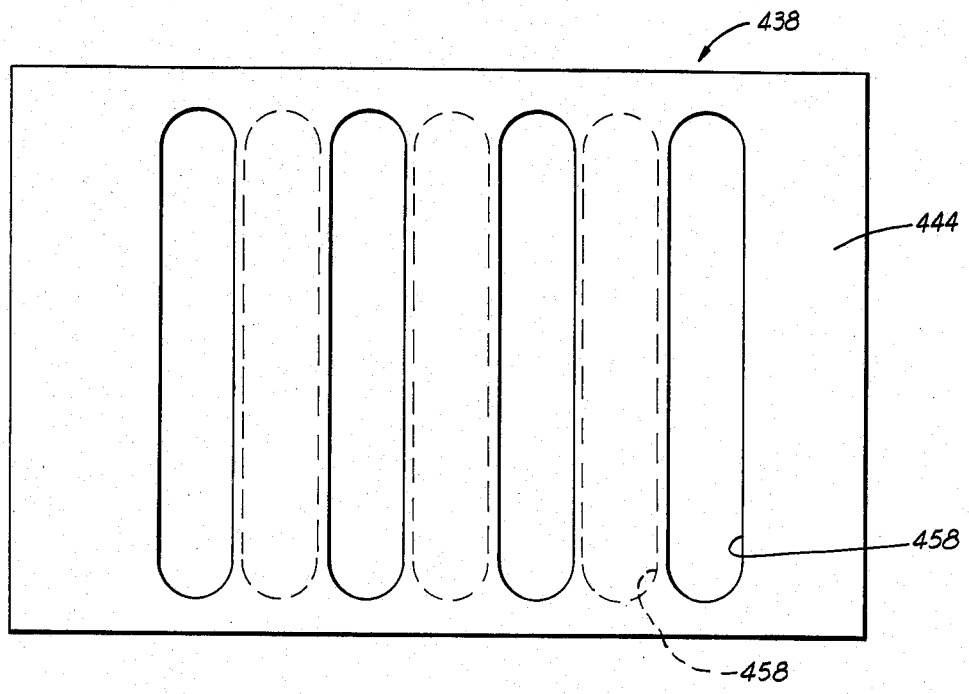
FIG. 4 is a view taken along lines 4—4 in FIG. 1.
Figure 5:
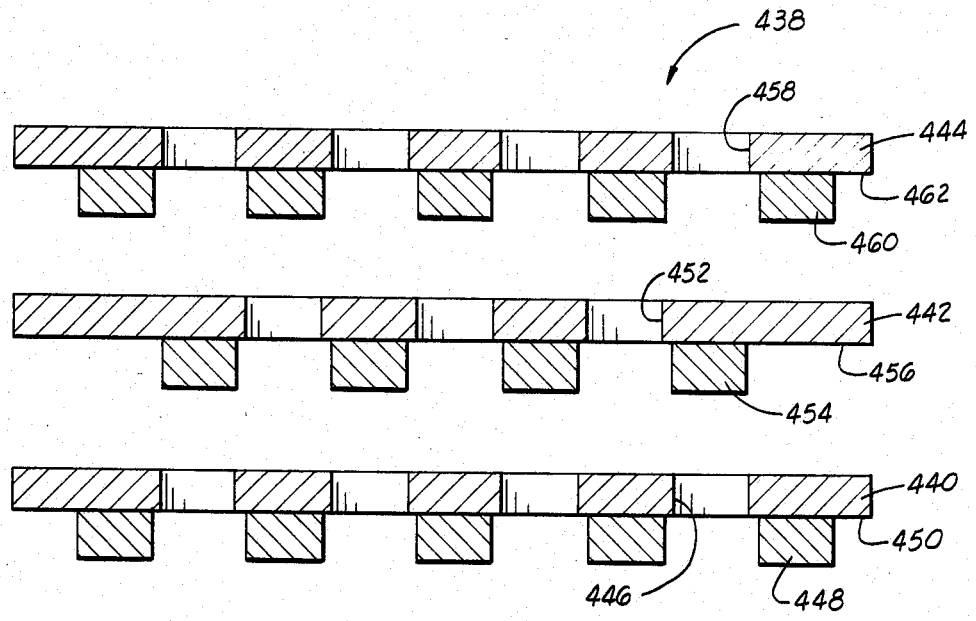
FIG. 5 is a cross-sectional view taken along lines 5—5 in FIG. 1.

Referring still to FIG. 1, air is drawn into the lower end of corridor 402 adjacent the treated surface, as indicated by arrow 436, by a fan hereinafter described. The air flows upwardly through chute 402 with abrasive 400 and then passes upwardly through a baffle assembly 438. Referring now to FIGS. 4 and 5, baffle assembly 438 is shown in detail. In the preferred embodiment, baffle assembly 438 includes a lower baffle 440, a control baffle 442 and an upper baffle 444, but it will be clear to those skilled in the art that the number of baffles may be varied.

Lower baffle 440 defines a plurality of longitudinal slots 446 therethrough and, in an alternate embodiment, also has a plurality of longitudinally disposed magnets attached to a lower surface 450 thereof substantially parallel to slots 446. Central baffle 442 also has a plurality of parallel magnets 454 attached to lower surface 456 thereof. Similarly, upper baffle 442 has a plurality of slots 458 therethrough and, in the alternate embodiment, corresponding magnets 460 attached to lower surface 462 thereof parallel to the slots. Slots 446 in lower baffle 440 and slots 458 in upper baffle 444 are in substantial alignment, and slots 452 in central baffle 442 are staggered with respect to slots 446 and 458. Thus, any abrasive that might have a tendency to be carried upwardly with the flow of air which passes through baffle assembly 438 will be prevented from significant movement. Upwardly moving abrasive passing through slots 446 in lower baffle 440 should impinge against lower surface 456 of central baffle 442 rather than passing through slots 452. However, any abrasive that does pass through slots 452 in central baffle 442 should impinge, and be stopped by, lower surface 462 of upper baffle 444. In the alternate embodiment of baffle assembly 438, upwardly carried abrasive moving toward slots 446 will most likely be attracted, and stopped, by magnets 448, but any abrasive that does pass upwardly through slots 446 will almost certainly impinge against magnets 454 and be retained thereby, or at least stopped so that it can fall downwardly toward lower auger 410. Similarly, any abrasive that by chance passes through slots 452 should impinge magnets 460. Thus, in either embodiment, baffle assembly 438 provides a passage for air flow that should prevent any appreciable upward movement of abrasive therethrough. However, the air moving upwardly through baffle assembly 438 will carry dust and nonferrous light debris from the treated surface, thus, providing a first cleaning of the abrasive.

Referring again to FIG. 1, air, and the dust and debris contained therein, which exits baffle assembly 438 moves rearwardly with respect to the surface blasting apparatus as indicated by arrow 464 and is directed through the falling abrasive curtain 434 as indicated by arrow 466. This further removed debris from the abrasive, providing a second cleaning thereof. The flow of air and debris is controlled by air valve 468 and moves upwardly and rearwardly through air duct 470 to enter first cleaning chamber 472.

Figure 2:
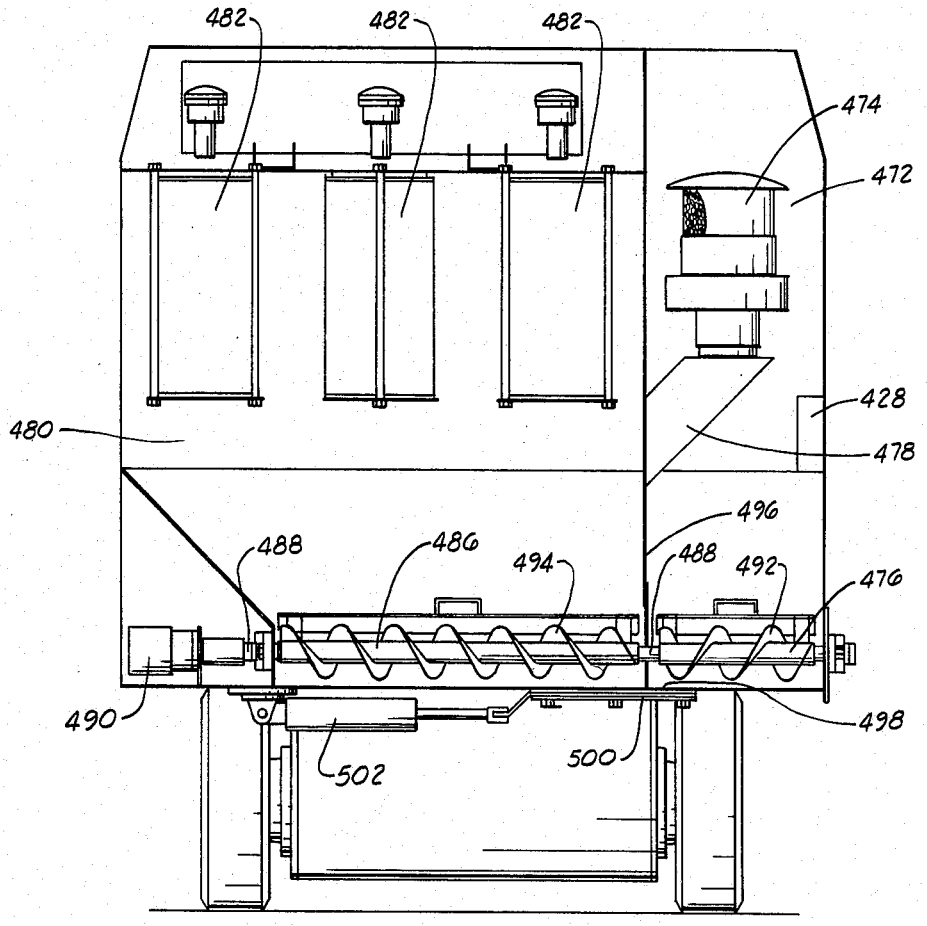
FIG. 2 is a partial cross-section taken along lines 2—2 in FIG. 1.

Referring now to FIGS. 1 and 2, the air and debris in first cleaning chamber 472 enters at least one prefilter 474. In the preferred embodiment, prefilter 474 is a cyclonic separator of the type disclosed in co-pending U.S. patent application Ser. No. 498,846. Heavy dust and debris is discharged from prefilter 474 so that it falls downwardly toward large debris auger 476 positioned at the lowermost end of first cleaning chamber 472. Large debris chute 428 also exits into first cleaning chamber 472 so that the large debris entering the chute from filter screen 420 falls downwardly towards auger 476 along with the heavy dust from prefilter 478.

The air and some light dust still contained therein exits first cleaning chamber 472 through discharge conduit 478 and enters second air cleaning chamber 480. The air and dust then flow through at least one filter 482 which removes essentially the remainder of the dust. Clean air exits the apparatus through discharge opening 484. Dust cleaned by filters 482 falls toward dust auger 486 located at the lowermost portion of second cleaning chamber 480. This is also similar to the filtering disclosed in co-pending application Ser. No. 498,846.

It will be seen that large debris auger 476 and dust auger 486 are mounted on a common shaft 488 which is driven by motor 490. The pitch of blades 492 on auger 476 and blades 494 on auger 486 are in opposite directions. Thus, as motor 490 turns shaft 488, augers 476 and 486 act as an auger means by which the debris and dust are moved transversely in both first and second cleaning chambers 472 and 480 toward divider wall 496 between the chambers. The lowermost portions of first cleaning chamber 472 and second cleaning chamber 480 adjacent wall 496 define a common opening 498 covered by a movable door 500 actuated by hydraulic cylinder 502. Door 500 can be opened when desired to remove dust and debris from the first and second cleaning chambers through opening 498.

Air is continuously drawn through abrasive chute 402, baffle assembly 438, air duct 470, first cleaning chamber 472 and second cleaning chamber 480 by a rotary fan (not shown) of a kind known in the art such as described in co-pending application Ser. No. 498,846.

It can be seen, therefore, that the surface blasting apparatus of the present invention is well adapted to carry out the objects and attain the ends and advantages mentioned, as well as those inherent therein. While a presently preferred embodiment of the invention has been described for the purposes of this disclosure, numerous changes in the construction and arrangement of parts can be made by those skilled in the art. All such changes are encompassed within the scope and spirit of this invention as defined by the appended claims.

What is claimed is:

1. A surface blasting apparatus comprising:

an abrasive blast wheel for throwing abrasive against a surface to be treated;

an abrasive storage hopper for providing a supply of abrasive to said abrasive blast wheel;

an abrasive return chute for receiving abrasive rebounded from said surface to be treated, along with dust and debris resulting from a treatment of said surface, and for conducting a flow of air along a flow path through said return chute;

magnetic receiving means positioned adjacent an exit of said abrasive return chute for receiving and arresting abrasive exiting said abrasive return chute;

a baffle assembly positioned adjacent said magnetic receiving means and above abrasive exiting said abrasive return chute, said baffle assembly allowing flow of air and dust upwardly therethrough, while preventing upward movement of a major portion of the abrasive therethrough;

an upper abrasive compartment having a lower end portion, and located above said abrasive storage hopper and separated therefrom by a space through which air and dust from said baffle assembly moves;

means for conducting air through a path from said baffle assembly to and through said space between said upper abrasive compartment and said abrasive storage hopper;

an abrasive conveyor means for carrying abrasive from said abrasive return chute to said upper abrasive compartment;

a screen disposed in the lower portion of said upper abrasive compartment for removing large debris from abrasive passing through said screen;

an abrasive control valve disposed below said screen in the lower end portion of said upper abrasive compartment for controlling the movement of abrasive from said screen toward said abrasive storage hopper and for allowing abrasive to fall downwardly from said upper abrasive compartment to said abrasive storage hopper across said space separating said upper abrasive compartment from said storage hopper such that air exiting from said baffle assembly and passing through said space passes through said falling abrasive for further removal of dust and debris therefrom;

a large debris chute positioned adjacent said screen for receiving large debris separated by said screen from abrasive;

a first cleaning chamber positioned near the discharge end of said large debris chute for receiving said large debris from said chute, and for receiving air, and said dust and debris contained in said air after said air and dust and debris have moved through said space between said upper abrasive compartment and said storage hopper, said first cleaning chamber having a lower portion;

a prefilter positioned in said first cleaning chamber for receiving air, dust and debris moved into said first cleaning chamber after passage through said space, and for filtering at least a portion of said dust and debris from said air so that the filtered dust and debris fall by gravity toward said lower portion of said first cleaning chamber;

a second cleaning chamber positioned adjacent said first cleaning chamber and receiving air with residual debris therein discharged from said prefilter located in said first cleaning chamber, said second cleaning chamber having a lower portion, and said first and second cleaning chambers defining a common opening in the lower portions thereof;

a filter positioned in said second cleaning chamber and having air and residual debris received from said first cleaning chamber into said second cleaning chamber directed therethrough for further filtering residual dust from said air such that said dust falls down into said lower portion of said second cleaning chamber;

a large debris auger positioned in the lower portion of said first cleaning chamber for transferring said large debris and dust toward said common opening; and a dust auger positioned in the lower portion of said second cleaning chamber for transferring said dust toward said common opening.

2. The apparatus of claim 1 wherein said large debris auger and said dust auger are mounted on a single shaft extending through said lower portions of said first and second cleaning chambers.

3. In a surface blasting apparatus for cleaning a surface by directing abrasive particles thereagainst at a high velocity, and which apparatus includes a rotatable, abrasive particle propelling wheel for propelling abrasive particles against said surface to be cleaned, and means for recycling abrasive particles rebounding from said surface to a hopper for resupply to the abrasive propelling wheel through a circuitous return path, the improvement for cleaning the abrasive particles prior to their return to the hopper which comprises:

a screen interposed in said circuitous return path for supporting and removing large debris from abrasive particles moving toward said hopper in said circuitous return path;

a chute positioned adjacent said screen and beneath one end thereof for receiving said large debris therefrom;

a fan moving a stream of air along at least a portion of said circuitous return path in admixture with abrasive particles moving through such circuitous return path, and for pulling a substantial portion of said air stream out of said circuitous return path at a first location, and then across and through abrasive particles moving through said circuitour return path at a second location nearer to said hopper than said first location;

passageway means for conducting and directing said substantial portion of said air stream from said first location to said second location;

dust removing means interposed in said substantial portion of said air stream downstream from said second location for removing dust from the substantial portion of said air stream after it has passed across and through said abrasive moving in said circuitous path toward said hopper, said dust removing means separating dust which is thereby removed from said substantial portion of said air stream into a first dust portion and a second dust portion;

a first cleaning chamber adjacent one end of said large debris chute for receiving said large debris from said large debris chute and for receiving said first portion of dust separated from said air stream by said dust removing means;

a second cleaning chamber adjacent said first cleaning chamber for receiving said second portion of said dust removed by said dust removing means, said first and second cleaning chambers defining a common opening accessible to both of said cleaning chambers at the lower portions of said first and second cleaning chambers; and auger conveyor means for transferring said dust and large debris toward said common opening as said dust and large debris gravitates onto said conveyor means within said first and second cleaning chambers.

4. The apparatus of claim 3 wherein said auger conveyor means is characterized by:

a rotatable shaft extending through said lower portions of said first and second cleaning chambers across said common opening;

a large debris helical auger blade positioned in said first cleaning chamber and secured around said shaft for rotation therewith, said large debris helical auger blade having a pitch direction to move dust and large debris toward said common opening; and a helical dust aguer blade positioned in the lower portion of said second cleaning chamber and secured around said shaft for rotation therewith, said helical auger blade having the helically turned blade pitched in the opposite direction from said first-mentioned large debris helical blade for moving dust gravitating on to said dust auger from said second cleaning chamber in the direction of said common opening;

whereby, as said shaft is rotated, said dust and large debris in said first cleaning chamber are moved toward said common opening, and said dust in said second cleaning chamber is concurrently moved toward said common opening in a direction opposite to the direction of movement of dust and large debris moved by said large debris auger in said first cleaning chamber.

5. A surface blasting apparatus comprising:

an abrasive blast wheel for throwing abrasive against a surface to be treated;

an abrasive storage hopper located above said blast wheel for providing a gravitating supply of abrasive to said abrasive blast wheel;

an abrasive return chute for receiving abrasive rebounded from said surface, and for passing a stream of rebounding abrasive upwardly in said chute;

means for inducing entry of air into said stream of abrasive for removal of dust and debris therefrom;

baffle means positioned adjacent and above an exit of said abrasive return chute for allowing said air and entrained dust and debris to flow therethrough while preventing abrasive flow therethrough and thus cooperating with said flowing air to remove dust and debris from said stream of abrasive;

an abrasive conveyor disposed in part below said baffle means and said return chute for receiving gravitating abrasive and carrying said abrasive to a position above said storage hopper;

means for directing abrasive from said abrasive conveyor into said storage hopper by way, in part, of a gravitating curtain of abrasive which extends across the path of air discharged from said baffle means after flowing therethrough, whereby further removal of dust and debris from said abrasive is effected as air moved from the baffle means to and through said gravitating curtain of abrasive; and passageway means for directing the flow of air between said baffle means and the point at which air is impinged upon abrasive in said gravitating curtain to effect said further removal of dust and debris from said abrasive.

6. A surface blasting apparatus conprising:

an abrasive blast wheel for throwing abrasive against a surface to be cleaned by the scouring action of abrasive particles impinging on said surface;

an abrasive storage hopper for gravitationally providing a supply of abrasive particles to said abrasive blast wheel;

an abrasive return chute for receiving abrasive particles rebounding upwardly from said surface to be cleaned by abrasive particle scouring action, and for conducting a stream of such rebounding abrasive particles upwardly and laterally in said chute at an angle to the vertical;

means for producing the entry of air into said stream of abrasive particles moving upwardly and laterally in said chute for movement with the particles;

baffle means defining an undulating, tortuous air-flow path from the lower side thereof to the upper side thereof, and positioned adjacent and above an exit at the upper end of said abrasive return chute for allowing said air to flow upwardly therethrough through said tortuous, undulating path around portions of said baffle means, while preventing the movement of abrasive particles upwardly through said baffle means in opposition to the force of gravity exerted downwardly thereon, to thereby enable the air moving through said baffle means to scrub the abrasive partcles to remove dust and debris therefrom;

magnetic abrasive particle receiving and arresting means positioned adjacent said baffle means at a location at one side of said baffle means in a substantially vertically extending plane which extends across and intersects the path of upward and lateral movement of said abrasive particles in said abrasive return chute after said particles have struck or passed by said baffle means, whereby a portion of the air moving upwardly in said return chute with said abrasive particles will impinge against said magnetic abrasive particle receiving and arresting means, and against abrasive particles magnetically held thereon, and whereby a portion of said abrasive particles shall impact said abrasive receiving and arresting means and be held thereon for subjection to a scrubbing action by air moving therepast, said held particles being removed from said arresting means by impact of additional magnetic particles rebounding upwardly in said abrasive return chute, said baffle means and said magnetic particle receiving and arresting means cooperating with each other and with gravity to (a) change the direction of movement of said abrasive particles from upward and laterally with respect to said surface to be cleaned, to downwardly in the general direction of said surface, and to (b) thoroughly air scrub said abrasive particles to remove dust and debris therefrom and entrain such dust and debris in air moving upwardly through said baffle means;

passageway means for conducting and directing the flow of air between said baffle means and said hopper; and conveyor means having a portion below said baffle means and said magnetic particle arresting means for catching gravitating abrasive particles falling from said baffle means and said arresting means, and conveying said abrasive particles to said abrasive storage hopper for reuse in said surface blasitng apparatus, said conveyor means, in addition to that portion below said baffle means, including:

an upper abrasive compartment spaced above said storage hopper for gravitating abrasive particles through the space between the upper abrasive compartment and the storage hopper through the stream of air passing through said passageway means after previously moving through said baffle means, whereby said gravitating abrasive particles are further cleaned by additional air scrubbing.

* * * * *

UNITED STATES PATENT AND TRADEMARK OFFICE

CERTIFICATE OF CORRECTION

PATENT NO. : 4,646,481

DATED : March 3, 1987

INVENTOR(S) : Wayne E. Dickson

It is certified that error appears in the above-identified patent and that said Letters Patent are hereby corrected as shown below:

In Column 3, line 11, delete "control" and insert -central-.
In Column 3, line 19, after the word "of" insert -slots 452 therethrough and, alternately, a plurality of-.

Signed and Sealed this

Sixth Day of October, 1987

*Attest:*

DONALD J. QUIGG

*Attesting Officer*

*Commissioner of Patents and Trademarks*